US008683968B2

(12) United States Patent
Yokoyama et al.

(10) Patent No.: US 8,683,968 B2
(45) Date of Patent: Apr. 1, 2014

(54) VARIABLE VALVE ASSEMBLY FOR INTERNAL COMBUSTION ENGINE

(75) Inventors: Yuu Yokoyama, Okazaki (JP); Masaki Numakura, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/696,194

(22) PCT Filed: May 12, 2010

(86) PCT No.: PCT/JP2010/058025

§ 371 (c)(1),
(2), (4) Date: Nov. 5, 2012

(87) PCT Pub. No.: WO2011/142007

PCT Pub. Date: Nov. 17, 2011

(65) Prior Publication Data

US 2013/0055980 A1 Mar. 7, 2013

(51) Int. Cl.
*F01L 1/34* (2006.01)
*F01L 1/344* (2006.01)

(52) U.S. Cl.
CPC ..... *F01L 1/3442* (2013.01)
USPC ..... 123/90.17; 123/90.15

(58) Field of Classification Search
CPC ..... F01L 1/3442
USPC ..... 123/90.15, 90.17, 90.31
See application file for complete search history.

(56) References Cited

U.S. PATENT DOCUMENTS 7,278,385 B2 * 10/2007 Knecht et al. ..... 123/90.17

FOREIGN PATENT DOCUMENTS

| | | |
|---|---|---|
| JP | A-06-299876 | 10/1994 |
| JP | A-2001-041012 | 2/2001 |
| JP | A-2009-167989 | 7/2009 |
| JP | A-2009-293580 | 12/2009 |

* cited by examiner

*Primary Examiner* — Zelalem Eshete
(74) *Attorney, Agent, or Firm* — Oliff PLC

(57) ABSTRACT

Provided is a variable valve assembly for internal combustion engines which is capable of accurately determining whether an input rotational component and an output rotational component are fixed to each other. The variable valve assembly includes an intake camshaft for driving an intake valve and a crankshaft for driving the camshaft. The variable valve assembly has a function for changing the relative rotational phase of the intake camshaft with respect to the crankshaft and a function for fixing the intake camshaft to the crankshaft. The variable valve assembly determines whether the intake camshaft is fixed to the crankshaft, on the basis of a total amount of phase variation HCC or the amount of variation in the relative rotational phase of the intake camshaft with respect to the crankshaft.

12 Claims, 9 Drawing Sheets

Displacement amount HA of intake valve
Fully open
0
720CA

Load torque HB
Phase retarding direction
Phase advancing direction
720CA

Phase variation amount HC
Phase advancing
Phase retarding
Phase retarding variation amount HCB
Phase advancing variation amount HCA
Total phase variation amount HCC
Reference variation range PK
720CA Detection portion position
94
91
95
94
92
95
94
93
95

Crank angle signal CB

[When there is no phase variation]
(PK)
(PK)
Cam angle signal DB
(CA)

[Fixed state]
PN1 (HCB)
PN2 (HCA)
Cam angle signal DB
(CA)
PNX

[Non-fixed state]
PN3 (HCB)
PN4 (HCA)
Cam angle signal DB
(CA)
PNX

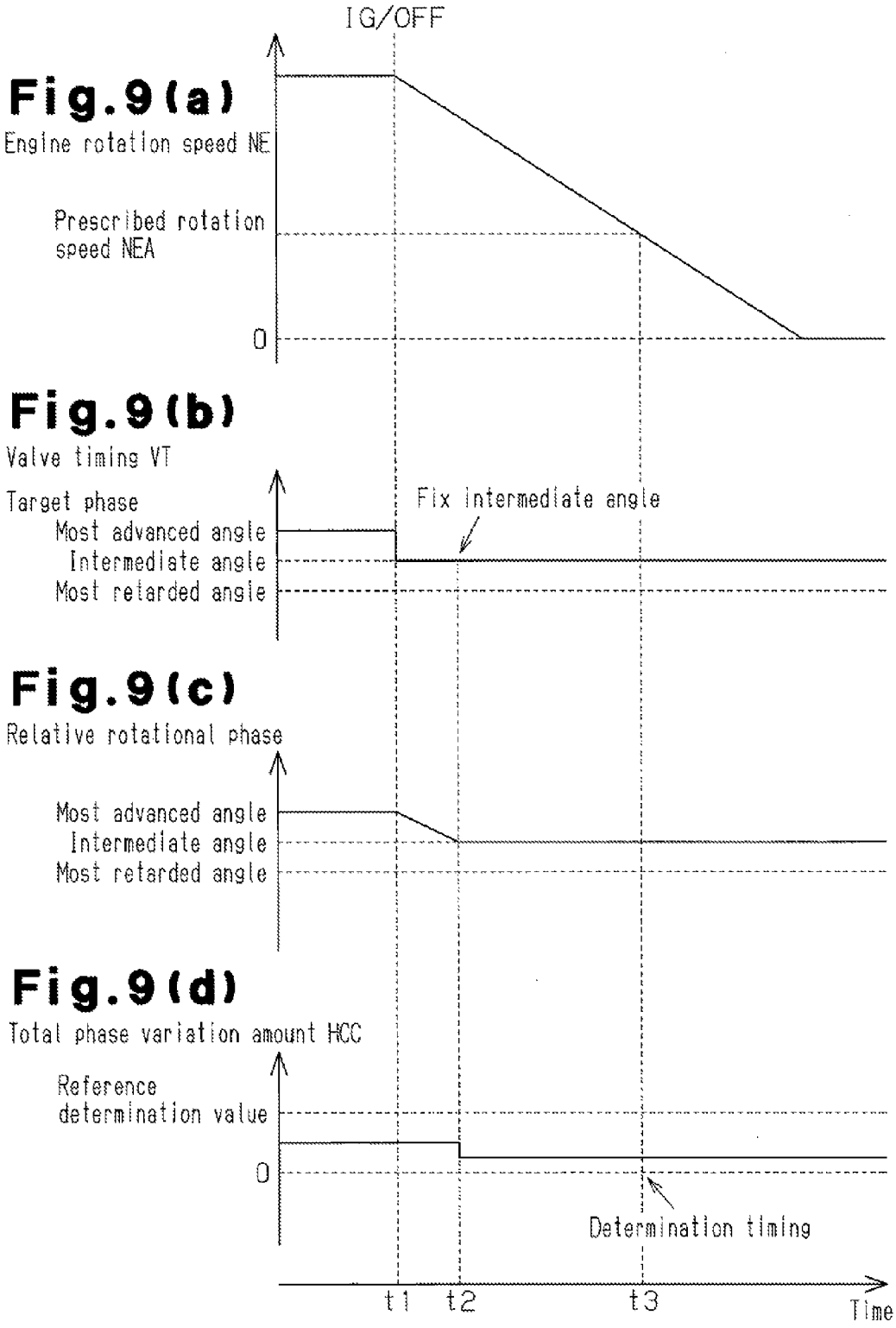
IG/OFF
Fig.9(a)
Engine rotation speed NE
Prescribed rotation speed NEA
0
Fig.9(b)
Valve timing VT
Target phase
Most advanced angle
Intermediate angle
Most retarded angle
Fix intermediate angle
Fig.9(c)
Relative rotational phase
Most advanced angle
Intermediate angle
Most retarded angle
Fig.9(d)
Total phase variation amount HCC
Reference determination value
0
Determination timing
t1
t2
t3
Time

VARIABLE VALVE ASSEMBLY FOR INTERNAL COMBUSTION ENGINE

FIELD OF THE DISCLOSURE

The present invention relates to a variable valve actuation device for an internal combustion engine including an output rotating body, which drives an engine valve, and an input, rotating body, which drives the output rotating body. The variable valve actuation device has a function for changing a relative rotational phase, which is a relative rotational phase of the output rotating body with respect to the input rotating body, and a function for fixing the input rotating body and the output rotating body with each other when the relative rotational phase is a specific phase.

BACKGROUND OF THE DISCLOSURE

As the variable valve actuation device, one described in Japanese Laid-Open Patent Publication No. 2009-167989 is known, for example.

The variable valve actuation device is provided with a sensor that determines whether the input rotating body and the output rotating body are fixed to each other. A deviation ratio is calculated, which is a ratio between a deviation amount in a positive direction and a deviation amount in a negative direction of an output signal of the sensor with respect to a reference value. The deviation ratio varies as follows depending upon whether or not the input rotating body and the output rotating body are fixed to each other. That is, when the rotating bodies are fixed to each other, the deviation ratio is not more than a predetermined value. When the rotating bodies are not fixed to each other, since the output rotating body oscillates with respect to the input rotating body, the deviation ratio becomes greater than the predetermined value. According to the variable valve actuation device, in a stoppage process of rotation of the internal combustion engine, it is determined that the rotating bodies are fixed to each other when the deviation ratio is not more than the predetermined value, and it is determined that the rotating bodies are not fixed to each other when the deviation ratio is greater than the predetermined value.

PRIOR ART DOCUMENT

Patent Document

Patent Document 1: Japanese Laid-Open Patent Publication No. 2009-167989

SUMMARY OF THE INVENTION

Problems that the Invention is to Solve

However, when lubricating oil remains in the variable valve actuation device, there is a possibility that a substantial difference is not generated between a deviation ratio when the output rotating body and the input rotating body are fixed to each other and a deviation ratio when the rotating bodies are not fixed to each other. Hence, it may be determined that the rotating bodies are fixed to each other when they are not fixed to each other.

Accordingly, it is an objective of the invention to provide a variable valve actuation device for an internal combustion engine that is capable of precisely determining whether the input rotating body and the output rotating body are fixed to each other.

Means for Solving the Problem

Means for achieving the aforementioned objective and advantages of the present invention will now be described. In the section of Means for Solving the Problem, a state where the input rotating body and the output rotating body are not fixed to each other is referred to as "non-fixed state" and a state where the rotating bodies are fixed to each other is referred to as "fixed state".

In accordance with the present invention, a variable valve actuation device for an internal combustion engine is provided. The device includes an output rotating body, which drives an engine valve, and an input rotating body, which drives the output rotating body. The variable valve actuation device has a function for changing a relative rotational phase, which is a rotational phase of the output rotating body with respect to that of the input rotating body, and a function for fixing the input rotating body and the output rotating body to each other when the relative rotational phase is a specific phase. It is determined whether the input rotating body and the output rotating body are fixed to each other based on a phase variation amount, which is a variation amount of the relative rotational phase.

When the output rotating body receives a force from the engine valve, the relative rotational phase is varied. If a variation amount of the relative rotational phase at the time of the non-fixed state and a variation amount of the relative rotational phase at the time of the fixed state are compared with each other, the former variation amount is greater than the latter variation amount. That is, the variation amount of the relative rotational phase is varied depending upon whether the input rotating body and the output rotating body are in the fixed state or the non-fixed state. In this invention, since it is determined whether the input rotating body and the output rotating body are fixed to each other based on the phase variation amount, it is possible to precisely make the determination.

The variable valve actuation device may further include an input angle sensor, which detects a rotational phase of the input rotating body, and an output angle sensor, which detects the rotational phase of the output rotating body. The phase variation amount is calculated based on an input angle signal, which is a detection signal of the input angle sensor, and an output angle signal, which is a detection signal of the output angle sensor.

The variable valve actuation device may calculate the phase variation amount based on a rising signal and a falling signal of the output angle signal detected by the output angle sensor.

The output angle sensor may be provided for detecting a timing rotor, which includes a first phase detection portion forming the rising signal and a second phase detection portion corresponding to the falling signal. The first phase detection portion may be provided near a location where a variation amount of a torque of the output rotating body becomes zero in a torque reducing process of the output rotating body. The second phase detection portion may be provided near a location where the variation amount of the torque of the output rotating body becomes zero in a torque increasing process of the output rotating body.

When the direction of the force applied from the engine valve to the output rotating body is opposite to the rotating direction of the rotating body, the torque of the output rotating body is reduced. When the variation amount of the torque becomes zero in a torque reducing process of the output rotating body, a phase variation amount in a phase retarding direction of the output rotating body becomes the maximum.

When the direction of the force is leading with respect to the rotating direction of the rotating body, the torque of the output rotating body increases. When the variation amount of the torque in a torque increasing process of the output rotating body becomes zero, a phase variation amount of the output rotating body in a phase advancing direction becomes the maximum. In this invention, since a rising signal is detected by the output angle sensor when the torque becomes zero in the torque reducing process of the output rotating body, it is possible to calculate the phase variation amount when the output rotating body is varied to the maximum level in the phase retarding direction. Since a falling signal is detected when the torque becomes zero in the torque increasing process of the output rotating body, it is possible to calculate the phase variation amount when the output rotating body is varied to the maximum level in the phase advancing direction.

The variable valve actuation device may calculate the phase variation amount based on the rising signal of the output angle signal detected by the output angle sensor, and the output angle sensor may detect, as the rising signal, timing when a torque applied to the output rotating body is switched from a phase retarding direction to a phase advancing direction.

When the direction of the force applied from the engine valve to the output rotating body is changed from the direction opposite to that of the rotating body to the leading direction with respect to the rotating direction of the rotating body, the rotational phase of the output rotating body with respect to the input rotating body is largely varied toward the phase retarding side. In this invention, the output angle sensor detects timing when the torque applied to the output rotating body is changed from the phase retarding direction (direction opposite from the rotating body) to the phase advancing direction (leading direction of the rotating body). Therefore, it is possible to detect the variation amount of the relative rotational phase of the output rotating body with respect to the input rotating body toward the phase retarding side.

The variable valve actuation device may calculate the phase variation amount based on the falling signal of the output angle signal detected by the output angle sensor, and the output angle sensor may detect, as the falling signal, timing when a torque applied to the output rotating body is switched from a phase advancing direction to a phase retarding direction.

When the direction of the force applied from the engine valve to the output rotating body is changed from the leading direction to the opposite direction with respect to the rotating direction of the rotating body, a phase of the output rotating body relative to the input rotating body is largely varied toward the phase advancing side. In this invention, the output angle sensor detects timing when the torque applied to the output rotating body is changed from the phase advancing direction (leading direction of the rotating body) to the phase retarding direction (opposite direction from the rotating body). Therefore, it is possible to detect the variation amount of the rotational phase of the output rotating body relative to the input rotating body toward the phase advancing side.

The output angle sensor may detect first timing when a torque applied to the output rotating body is switched from a phase retarding direction to a phase advancing direction, and second timing when the torque applied to the output rotating body is switched from the phase advancing direction to the phase retarding direction, and the phase variation amount may be calculated based on the first timing and the second timing.

According to this invention, the phase variation amount is calculated based on the first timing related to the variation amount of the relative rotational phase toward the phase retarding side and the second timing related to the variation amount of the relative rotational phase toward the phase advancing side. Therefore, it is possible to more precisely calculate the phase variation amount.

When the internal combustion engine is in a stoppage process, the variable valve actuation device may determine whether the input rotating body and the output rotating body are fixed to each other.

In this invention, it is determined whether the rotating bodies are in the fixed state or the non-fixed state in the stoppage process of rotation of the internal combustion engine. Hence, when the engine is started next time, it is possible to control the starting state in accordance with the fixed state or the non-fixed state.

When an engine rotation speed is reduced to a prescribed rotation speed in the stoppage process of the internal combustion engine, the variable valve actuation device may determine whether the input rotating body and the output rotating body are fixed to each other.

It is preferably determined whether or not the input rotating body and the output rotating body are fixed to each other at a late timing in the stoppage process of the internal combustion engine. If this determination is made at early timing in the stoppage process of the internal combustion engine, there is a possibility that the input rotating body and the output rotating body are fixed to each other due to rotations of these rotating bodies thereafter. In this case, the determination is different from the actual fixed state between the input rotating body and the output rotating body. In this aspect, according to the present invention of the application, since the determination is made after the engine rotation speed is lowered to the prescribed rotation speed, it is possible to lower the frequency that the determination result and the actual fixed state between the input rotating body and the output rotating body are different from each other.

When the phase variation amount is smaller than a reference determination value, the variable valve actuation device may determine that the input rotating body and the output rotating body are fixed to each other. When the phase variation amount is greater than the reference determination value, the variable valve actuation device may determine that the input rotating body and the output rotating body are not fixed to each other.

The reference determination value may be renewed based on the input angle signal and the output angle signal when the output rotating body and the input rotating body are fixed to each other.

The variable valve actuation device has individual differences. That is, an oscillation degree of the output rotating body with respect to the input rotating body differs depending upon a variation in size of the output rotating body and the input rotating body and an assembling variation therebetween. In this aspect, according to this invention, the reference determination value for determining whether the output rotating body is fixed to the input rotating body is renewed based on the input angle signal and the output angle signal when the output rotating body and the input rotating body are fixed to each other. According to this configuration, it is possible to more precisely make a determination.

After the internal combustion engine is started and when the output rotating body and the input rotating body are fixed to each other, the reference determination value may be renewed based on the input angle signal and the output angle signal.

According to this invention, the reference determination value is renewed before the internal combustion engine is stopped. Hence, it is possible to determine whether the input rotating body and the output rotating body are fixed to each other using the reference determination value when the engine is stopped thereafter.

The variable valve actuation device may further include a function for fixing the input rotating body and the output rotating body to each other when the internal combustion engine is automatically stopped. When the internal combustion engine is automatically stopped and the input rotating body and the output rotating body are fixed to each other, the reference determination value may be renewed based on the input angle signal and the output angle signal.

According to this invention, the reference determination value is renewed when the internal combustion engine is automatically stopped. Therefore, it is possible to obtain the reference determination value under a condition closer to a state when the internal combustion engine is stopped than a state when the engine is started. According to this configuration, it is possible to more precisely determine whether the input rotating body and the output rotating body are fixed to each other.

If the relative rotational phase is not fixed when the internal combustion engine is started, the variable valve actuation device may delay starting timing of fuel injection as compared with a case where the relative rotational phase is fixed.

When the engine is started and the rotating bodies are in the non-fixed state, injected fuel is not easily burned. In this invention, the starting timing of the fuel injection when the engine is started and the rotating bodies are in the non-fixed state is set later than the starting timing of the fuel injection when the engine is started and the rotating bodies are in the fixed state. Therefore, it is possible to reduce the amount of injected fuel that adheres to a spark plug for example.

In accordance with the present invention, another variable valve actuation device for an internal combustion engine is provided. The device includes an output rotating body, which drives an engine valve, and an input rotating body, which drives the output rotating body. The variable valve actuation device has a function for changing a relative rotational phase, which is a rotational phase of the output rotating body with respect to that of the input rotating body, and a function for fixing the input rotating body and the output rotating body to each other when the relative rotational phase is a specific phase. The variable valve actuation device further includes an input angle sensor, which detects a phase of the input rotating body, and an output angle sensor, which detects a rotational phase of the output rotating body. The output angle sensor detects, as first detecting timing, timing when a torque applied to the output rotating body is switched from a phase advancing direction to a phase retarding direction, and detects, as second detecting timing, timing when the torque applied to the output rotating body is switched from the phase retarding direction to the phase advancing direction. When a period variation amount, which is a variation amount of an interval between the first detecting timing and the second detecting timing is smaller than a reference determination value, it is determined that the output rotating body is fixed to the input rotating body. When the period variation amount is greater than the reference determination value, it is determined that the output rotating body is fixed to the input rotating body.

In the non-fixed state, the relative rotational phase is varied when the output rotating body receives a force from the engine valve. In the fixed state, the variation amount of the relative rotational phase when the output rotating body receives the force from the engine valve becomes smaller than that of the non-fixed state. That is, the variation amount of the relative rotational phase is varied depending upon whether the input rotating body and the output rotating body are in the fixed state or the non-fixed state. In this invention, since it is determined whether the input rotating body and the output rotating body are fixed to each other based on the period variation amount, it is possible to precisely make the determination.

BRIEF DESCRIPTION OF THE DRAWINGS

FIG. 9 is a timing chart showing a transition of a total phase variation amount when the engine is stopped in the variable valve actuation device of the embodiment;

DETAILED DESCRIPTION OF THE PREFERRED EMBODIMENTS

Figure 1:
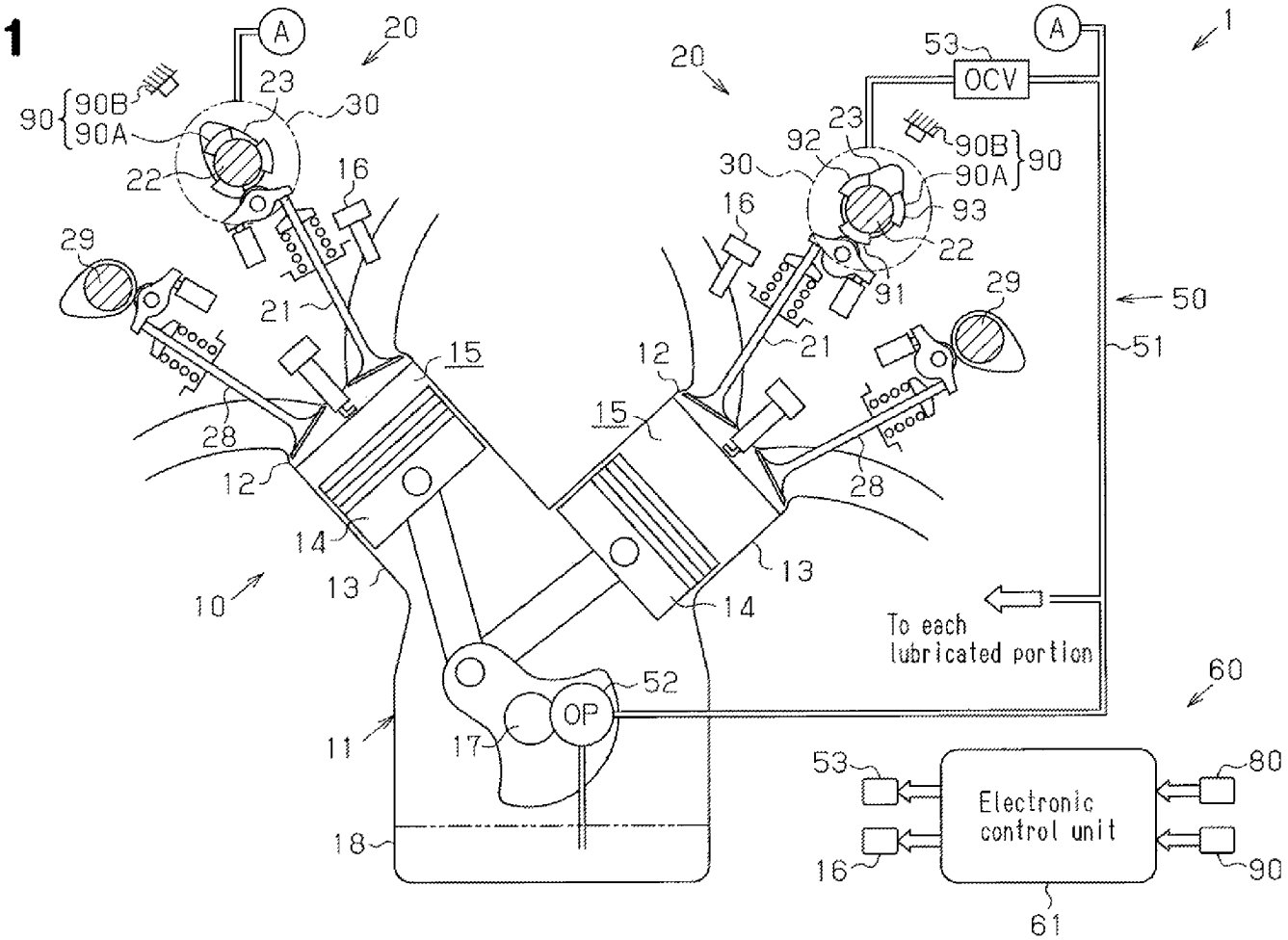
FIG. 1 is a schematic diagram showing a structure of an internal combustion engine according to a first embodiment of the present invention.

One embodiment of the present invention will be described with reference to FIGS. 1 to 10. In this embodiment, the present invention is embodied as a variable valve actuation device of a V6 internal combustion engine.

The internal combustion engine 1 includes an engine body 10, variable valve actuation devices 20, a lubricating device 50, and a control unit 60. The engine body 10 has a cylinder block 11, cylinder heads 12 and an oil pan 18. The variable valve actuation devices 20 include various elements of a valve system provided in the cylinder heads 12. The lubricating device 50 supplies lubricating oil to the engine body 10 and the like. The control unit 60 controls these elements in a centralized manner. Pistons 14 are provided to reciprocate in cylinders 13. A fuel injection valve 16 is provided in each of the cylinder heads 12. The fuel injection valve 16 injects fuel to an intake port.

Each of the variable valve actuation devices 20 includes an intake valve 21 and an exhaust valve 28, which open and close a combustion chamber 15, an intake camshaft (output rotating body) 22 and an exhaust camshaft 29, which respectively press down these valves, and a variable valve timing mechanism 30, which changes a rotational phase (valve timing VT, hereinafter) of the intake camshaft 22 with respect to the rotational phase of the crankshaft (input rotating body) 17.

The intake camshaft 22 includes three pairs of intake cams 23. Projecting directions of the three pairs of intake cams 23 are deviated from one another by 120 degrees. The three pairs of intake cams 23 are referred to as first intake cams 23A, second intake cams 23B and third intake cams 23C hereinafter.

The lubricating device 50 includes an oil pump 52, which discharges lubricating oil in the oil pan 18, a lubricating oil passage 51, through which lubricating oil discharged from the oil pump 52 is supplied to various elements of the internal combustion engine 1, and an oil control valve 53, which controls a supply state of lubricating oil to the variable valve timing mechanism 30.

The control unit 60 includes an electronic control unit 61, which carries out various calculation processes for controlling the internal combustion engine 1, and various sensors such as a crank position sensor 80 and a cam position sensor 90. The crank position sensor 80 outputs a signal (crank angle signal CB, hereinafter) corresponding to a rotation angle of the crankshaft 17 to the electronic control unit 61. The cam position sensor 90 is an output angle sensor, which outputs a signal (cam angle signal DB, hereinafter) corresponding to a rotation angle of the intake camshaft 22 to the electronic control unit 61.

The cam position sensor 90 is constituted as a magnetic sensor 90B. The magnetic sensor 90B is provided to detect a timing rotor 90A fixed to the intake camshaft 22. The timing rotor 90A includes a first detection portion 91 corresponding to the first intake cams 23A, a second detection portion 92 corresponding to the second intake cams 23B and a third detection portion 93 corresponding to the third intake cams 23C.

The magnetic sensor 90B outputs a high level signal when any of the detection portions 91, 92 and 93 is detected, and outputs a low level signal when none of the detection portions 91, 92, 93 is detected. That is, the magnetic sensor 90B detects a rising signal when leading ends 94 of the detection portions 91, 92 and 93 pass by the sensor 90B, and detects a falling signal when trailing ends 95 of the detection portions 91, 92 and 93 pass by the sensor 90B. A response speed of the rising signal is faster than that of the falling signal.

The electronic control unit 61 calculates the following value as parameters used for various kinds of control operations. That is, the electronic control unit 61 calculates a calculation value corresponding to the relative rotational phase of the intake camshaft 22 with respect to the crankshaft 17 based on the crank angle signal CB and the cam angle signal DB. The electronic control unit 61 controls injection timing of the fuel injection valve 16 based on an operation state of the engine.

Examples of the control operations performed by the electronic control unit 61 are valve timing control for changing the valve timing VT by the control of the variable valve timing mechanism 30, and fuel injection control for controlling an injection state of the fuel injection valve 16.

In the valve timing control, the valve timing VT is changed between most, advanced valve timing VT (most advanced angle VTmax" hereinafter) and most retarded valve timing VT (most retarded angle VTmin, hereinafter) based on the operation state of the engine. When the engine is stopped, the valve timing VT is changed to an intermediate angle VTmdl. At the intermediate angle VTmdl, the valve timing VT is in specific timing between the most advanced angle VTmax and the most retarded angle VTmin.

The configuration of the variable valve timing mechanism 30 will be described with, reference to FIG. 2. Arrow X in the drawing shows rotating directions of a sprocket 33 and the intake camshaft 22.

Figure 2A:
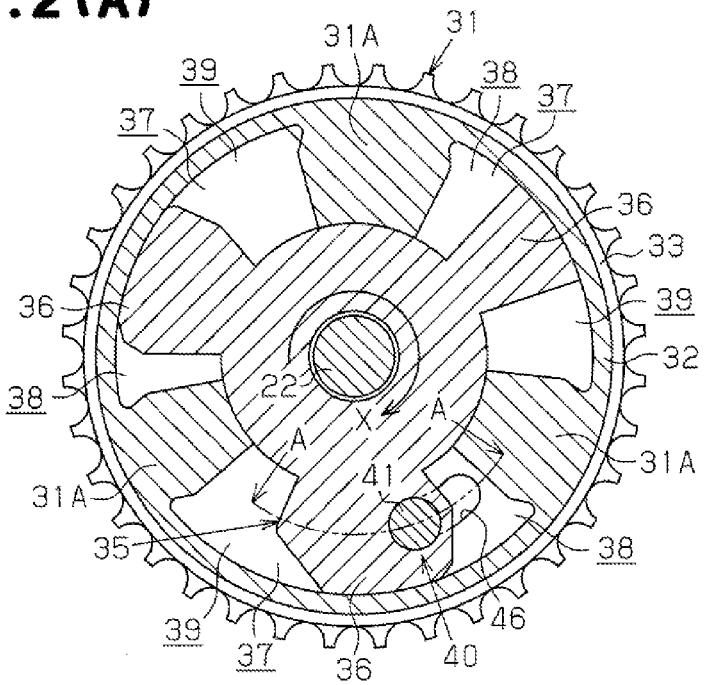
FIG. 2(A) is a cross-sectional view showing a cross-sectional structure of a variable valve timing mechanism of the embodiment.

As shown in FIG. 2(A), the variable valve timing mechanism 30 includes a housing rotor 31, which rotates in synchronization with the crankshaft 17, a vane rotor 35, which rotates in synchronization with the intake camshaft 22, and a phase fixing mechanism 40, which fixes the valve timing VT to the intermediate angle VTmdl.

The housing rotor 31 includes the sprocket 33 connected to the crankshaft 17 through a timing chain, a housing body 32, which is assembled inside of the sprocket 33 and rotates integrally with the sprocket 33, and a cover 34 mounted on the housing body 32. The housing body 32 is provided with three partition walls 31A, which project toward the rotary shaft (intake camshaft 22) of the housing rotor 31 in the radial direction.

The vane rotor 35 is fixed to an end of the intake camshaft 22 and located in a space in the housing body 32. The vane rotor 35 is provided with three vanes 36 each projecting toward a location between adjacent partition walls 31A of the housing body 32. Each of the vanes 36 partitions a vane accommodating chamber 37 formed between the partition walls 31A into a phase advancing chamber 38 and a phase retarding chamber 39.

An operation of the variable valve timing mechanism 30 will be described.

The phase advancing chamber 38 is enlarged and the phase retarding chamber 39 is shrunk by supply of lubricating oil to the phase advancing chamber 38 and discharge of lubricating oil from the phase retarding chamber 39. This rotates the vane rotor 35 to the phase advancing side with respect to the housing rotor 31, i.e., in a rotating direction X of the intake camshaft 22. According to these movements, the valve timing VT is advanced. When the vane rotor 35 rotates to the most advanced position with respect to the housing rotor 31, i.e., when the rotational phase of the vane rotor 35 with respect to the housing rotor 31 is a most advanced phase PA, the valve timing VT is set to the most advanced angle VTmax.

The phase retarding chamber 39 is enlarged and the phase advancing chamber 38 is shrunk by discharge of lubricating oil from the phase advancing chamber 38 and supply of lubricating oil to the phase retarding chamber 39, and the vane rotor 35 rotates to the phase retarding side with respect to the housing rotor 31, i.e., into a direction opposite from the rotating direction X of the intake camshaft 22. According to these movements, the valve timing VT is retarded. When the vane rotor 35 rotates to the most retarded position with respect to the housing rotor 31, i.e., when the rotational phase of the vane rotor 35 with respect to the housing rotor 31 is the most retarded phase PB, the valve timing VT is set to the most retarded angle VTmin.

When the vane rotor 35 rotates with respect to the housing rotor 31 and the rotational phase of the vane rotor 35 with respect to the housing rotor 31 is at a specific phase between the most advanced phase PA and the most retarded phase PB, i.e., at an intermediate phase PM, the valve timing VT is set to the intermediate angle VTmdl.

Figure 2B:
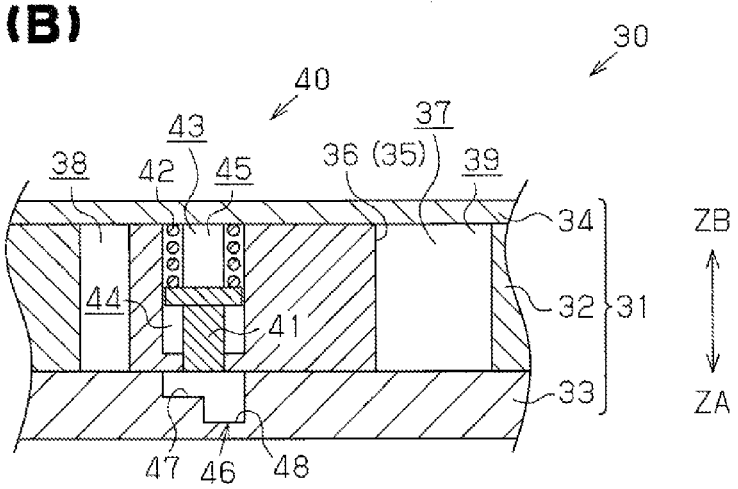
FIG. 2(B) is a cross-sectional view showing a cross-sectional structure taken along line A-A of FIG. 2(A)

As shown in FIG. 2(B), the phase fixing mechanism 40 includes an engaging portion 46 formed in the housing rotor 31, a limiting pin 41, which engages with the engaging portion 46, a limiting chamber 44, which receives supply of lubricating oil from the lubricating device 50, a limiting spring 42, which presses the limiting pin 41 in one direction, and a spring chamber 45, in which the limiting spring 42 is accommodated.

The limiting pin 41 is accommodated in an accommodating chamber 43, which is composed of the limiting chamber 44 and the spring chamber 45. The limiting pin 41 moves in an axial direction of a rotary shaft of the vane rotor 35 and projects from the accommodating chamber 43. In the following description, a direction in which the limiting pin 41 projects from the accommodating chamber 43 is defined as projecting direction ZA, and a direction in which the limiting pin 41 is accommodated in the accommodating chamber 43 is defined as accommodating direction ZB.

The engaging portion 46 includes an engaging hole 48, into which the limiting pin 41 is fitted, and an upper groove 47 having a depth smaller than that of the engaging hole 48. The engaging hole 48 is provided at a location corresponding to the intermediate phase PM. The upper groove 47 is formed to range from a retarded phase that is more retarded than the intermediate phase PM to the intermediate phase PM.

When hydraulic pressure is supplied to the limiting chamber 44, the limiting pin 41 is maintained in a state where it is accommodated in the vane 36. When hydraulic pressure in the limiting chamber 44 is discharged, the limiting pin 41 is maintained in a state where it projects from the vane 36. When the limiting pin 41 projects from the vane 36 and engages with the engaging hole 48, the rotational phase of the vane rotor 35 with respect to the housing rotor 31 is fixed to the intermediate phase PM. In the following description, a state where the rotational phase of the vane rotor 35 is fixed to the intermediate phase PM with respect to the housing rotor 31 is referred to as fixed state. A state where the rotational phase of the vane rotor 35 is not fixed to the intermediate phase PK with respect to the housing rotor 31 is referred to as non-fixed state.

Operation of the variable valve timing mechanism 30 and the phase fixing mechanism 40 will be described.

When the vane rotor 35 is not fixed to the housing rotor 31 at the time of start of the engine, the vane rotor 35 oscillates with respect to the housing rotor 31 due to cranking at the time of start of the engine. Since lubricating oil is not supplied to the limiting chamber 44, a force is applied to the limiting pin 41 by the limiting spring 42 in the projecting direction ZA. When the vane rotor 35 rotates and the limiting pin 41 is located on the upper groove 47, a distal end of the limiting pin 41 abuts against the bottom surface of the upper groove 47. When the vane rotor 35 further rotates and positions of the limiting pin 41 and the engaging hole 48 match with each other, the distal end of the limiting pin 41 abuts against the bottom surface of the engaging hole 48. The valve timing VT is fixed to the intermediate angle VTmdl in this manner.

When the vane rotor 35 is fixed to the housing rotor 31 at the time of start of the engine, the housing rotor 31 and the vane rotor 35 rotate integrally during cranking at the time of start of the engine.

During the operation of the engine, if a phase advancement of the valve timing VT is requested, the oil control valve 53 supplies lubricating oil to the phase advancing chamber 38. At this time, the oil control valve 53 supplies the lubricating oil to the limiting chamber 44. Hence, the vane rotor 35 rotates to the phase advancing side with respect to the housing rotor 31 in a state where the limiting pin 41 is accommodated in the accommodating chamber 43.

During the operation of the engine, if a phase retardation of the valve timing VT is requested, the oil control valve 53 supplies lubricating oil to the phase retarding chamber 39. At this time, the oil control valve 53 supplies lubricating oil to the limiting chamber 44. Hence, the vane rotor 35 rotates to the phase retarding side with respect to the housing rotor 31 in a state where the limiting pin 41 is accommodated in the accommodating chamber 43.

When the engine is stopped, if an intermediate angle for bringing the valve timing VT into the intermediate angle VTmdl is requested, a supply state of lubricating oil to the phase advancing chamber 38 and the phase retarding chamber 39 is controlled by the oil control valve 53 such that the rotational phase of the vane rotor 35 with respect to the housing rotor 31 is brought into the intermediate phase PM. When the engine is stopped, since hydraulic pressure is reduced due to reduction in rotation of the oil pump 52, a force in the projecting direction ZA is applied to the limiting pin 41. Hence, when the rotational phase of the vane rotor 35 with respect to the housing rotor 31 becomes equal to the intermediate phase PM, the limiting pin 41 is fitted into the engaging hole 48. According to this configuration, the valve timing VT is fixed to the intermediate angle VTmdl.

Figure 3:
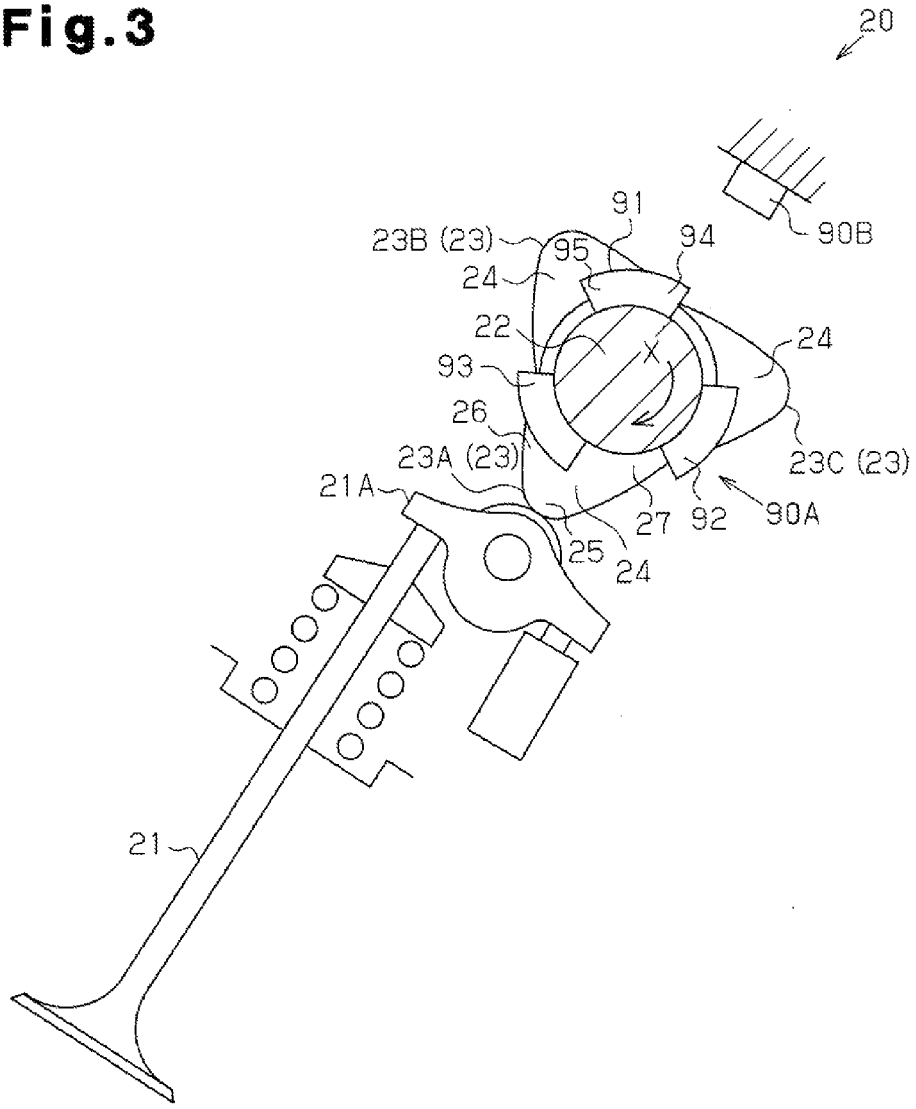
FIG. 3 is a schematic cross-sectional view showing a positional relationship between an intake valve, an intake cam and a cam position sensor of the embodiment.

A positional relationship between the intake valve 21, the intake cam 23 and the magnetic sensor 90B will be indicated schematically with reference to FIG. 3.

The positions of the first detection portion 91, the second detection portion 92 and the third detection portion 93 of the timing rotor 90A are determined in relationship to the intake cams 23. The positional relationship between the first intake cams 23A and the first detection portion 91 will be described below. The relationship between the second intake cams 23B and the second detection portion 92, and the relationship between the third intake cams 23C and the third detection portion 93 are the same as the positional relationship between the first intake cams 23A and the first detection portion 91.

A leading end 94 of the first detection portion 91 is provided at a position where the leading end 94 is detected by the magnetic sensor 90B when a vertex 25 of the nose 24 of the first intake cam 23A abuts against a roller of a rocker arm 21A of the intake valve 21. A trailing end 95 of the first detection portion 91 is provided at a position where the trailing end 95 is detected by the magnetic sensor 90B when the trailing skirt 27 of the nose 24 of the first, intake cams 23A comes into contact with the roller of the rocker arm 21A.

That is, the leading end 94 of the first detection portion 91 is for detecting timing (first, timing) when a load torque HB applied to the intake camshaft 22 is switched from the phase retarding direction to the phase advancing direction. The trailing end 95 of the first detection portion 91 is for detecting timing (second timing) when the load torque HB applied to the intake camshaft 22 is switched from the phase advancing direction to the phase retarding direction.

Figures 4A, 4B, 4C, 4D:
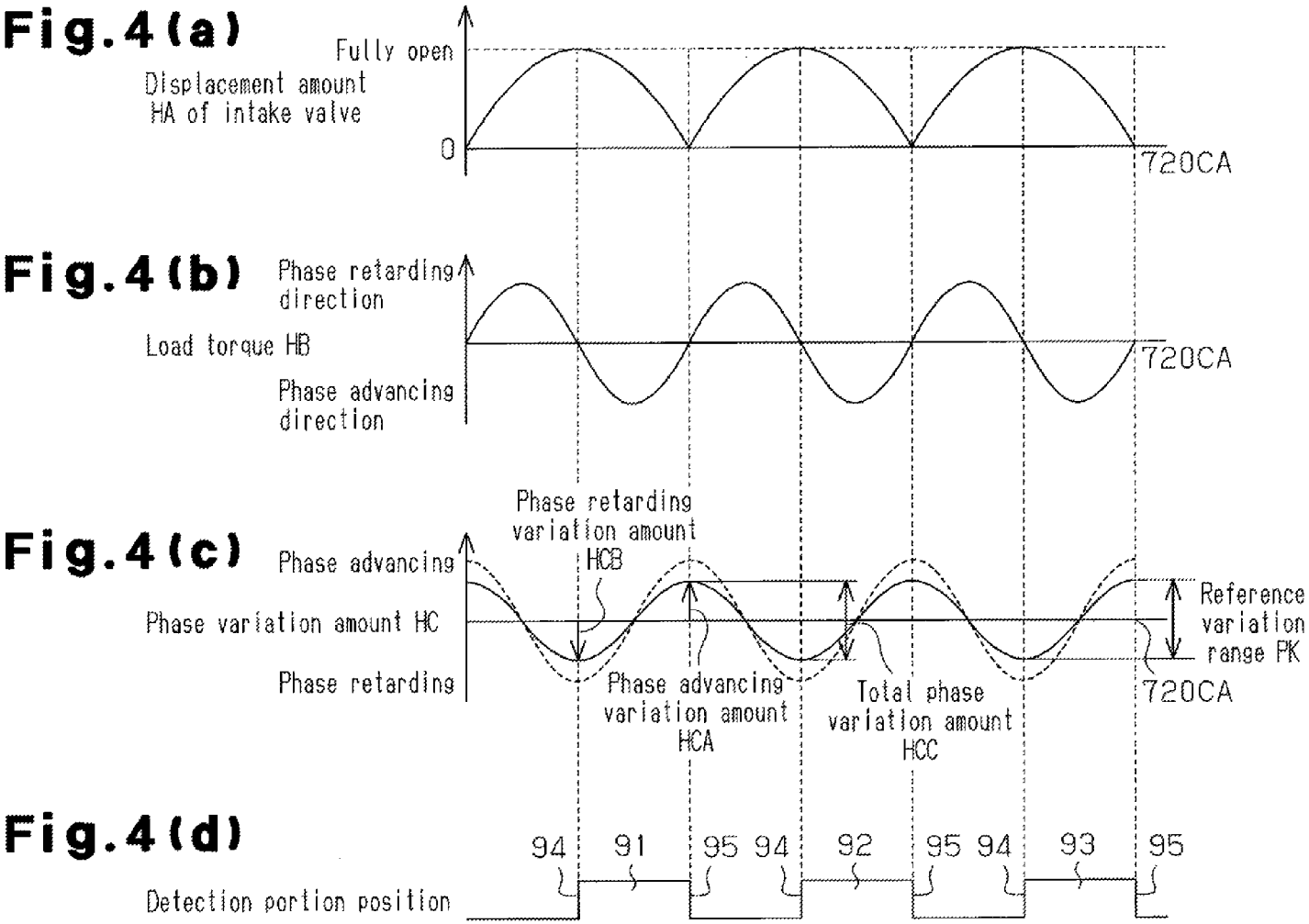
FIG. 4 is a schematic diagram showing a relationship between a displacement amount of the intake valve, a torque of an intake camshaft, a phase variation amount of the intake camshaft and a detection portion in a variable valve actuation device of the embodiment.

With reference to FIG. 4, described will be a relationship between a displacement amount HA of the intake valve 21, the load torque HB, which is generated by a force applied from the intake valve 21 to the intake cam 23 and is applied to the intake cam 23, a variation amount of the relative rotational phase (phase variation amount HC, hereinafter) between the crankshaft 17 and the intake camshaft 22, the leading ends 94 and the trailing ends 95 of the detection portions 91, 92 and 93. FIG. 4 shows variation of parameters during one cycle of the intake camshaft 22, i.e., a period (720CA) of two rotations of the crankshaft 17 when one rotation of the crankshaft 17 is defined as 360CA.

FIG. 4(*a*) shows the displacement amount HA of the intake valve 21. The noses 24 of the first intake cams 23A, the second intake cams 23B and the third intake cams 23C come into contact with the roller of the rocker arm 21A corresponding to the intake cams 23. Displacement cycles of the first intake cams 23A, the second intake cams 23B and the third intake cams 23C are deviated from one another by one third of a cycle. When the vertex 25 of the nose 24 of each of the intake cams 23 comes into contact with the roller of the rocker arm 21A, the intake valve 21 corresponding to the intake cam 23 is displaced to the lowest position, and the intake valve 21 is fully opened, i.e., the displacement amount HA becomes the maximum.

FIG. 4(*b*) shows a variation of a torque applied to the intake camshaft 22.

When the intake valve 21 starts opening, i.e., when a leading skirt 26 of the nose 24 of the intake cam 23 starts coming into contact with the roller of the rocker arm 21A, a force of the intake valve 21 is applied to a direction opposite from the rotating direction of the intake camshaft 22. Hence, the load torque HB applied to the intake camshaft 22 in the phase retarding direction is increased. At this time, a rotation torque of the intake camshaft 22 is reduced.

Thereafter, when the intake camshaft 22 rotates and the contacted portions between the nose 24 of the intake cam 23 and the roller of the rocker arm 21A move, the load torque HB applied to the intake camshaft 22 in the phase retarding direction is reduced. At this time, the rotation torque of the intake camshaft 22 is increased. A period during which the rotation torque of the intake camshaft 22 is increased is referred to as torque increasing process.

When the intake valve 21 starts closing from its fully opened state, i.e., when a portion of the intake cam 23 closer to the phase retarding side than the vertex 25 of the nose 24 comes into contact with the roller of the rocker arm 21A, a force of the intake valve 21 is applied in the rotating direction of the intake camshaft 22. Hence, the load torque HB applied to the intake camshaft 22 in the phase advancing direction is increased.

Thereafter, the contacted portions between the nose 24 of the intake cam 23 and the roller of the rocker arm 21A move, the load torque HB applied to the intake camshaft 22 in the phase advancing direction starts reducing. At this time, the rotation torque of the intake camshaft 22 starts reducing. A period during which the rotation torque of the intake camshaft 22 is reduced is referred to as torque reducing process.

When the trailing skirt 27 of the nose 24 of the intake cam 23 comes into contact with the roller of the rocker arm 21A, a force of the intake valve 21 applied to the intake camshaft 22 in the rotating direction disappears. Hence, the load torque HB applied to the intake camshaft 22 becomes zero and thereafter, the load torque HB of the intake camshaft 22 is increased from the reduced state.

Each time the nose 24 of the intake cam 23 comes into contact with the roller of the rocker arm 21A, forces are applied to the intake camshaft 22 from the intake valves 21. Hence, the load torque HB applied to the intake camshaft 22 is varied every one third cycle.

FIG. 4(*c*) shows the phase variation amount HC of the intake camshaft 22. The intake camshaft 22 oscillates toward the phase advancing side and the phase retarding side with respect to rotation of the crankshaft 17. When the intake valve 21 is displaced to the lowest position, the intake camshaft 22 oscillates to the most retarded position. That is, a phase variation amount (retarding variation amount HCB, hereinafter) on the phase retarding side becomes maximum on the phase retarding side.

When the displacement, amount HA of the intake valve 21 is the smallest, the intake camshaft 22 oscillates to the most advanced position. At this time, the phase variation amount on the phase advancing side (phase advancing variation amount HCA, hereinafter) becomes maximum on the phase advancing side.

The phase advancing variation amount HCA and the phase retarding variation amount HCB are varied depending upon the temperature and hydraulic pressure of lubricating oil supplied to the variable valve timing mechanism 30 and depending upon whether or not the variable valve timing mechanism 30 is in the fixed state.

A relative rotational phase at which the phase retarding variation amount HCB and the phase advancing variation amount. HCA become zero is not advanced or retarded, and is set to a substantially constant relative rotational phase. This relative rotational phase becomes an average relative rotational phase (reference relative rotational phase PK, hereinafter) of the intake camshaft 22 with respect, to the crankshaft 17.

FIG. 4(*d*) shows the relationship among positions where the leading end 94 and the trailing end 95 are detected by the magnetic sensor 90B, the displacement amount HA of the intake valve 21, the load torque HB applied to the intake camshaft 22, and the phase variation amount HC.

The leading ends 94 of the detection portions 91, 92 and 93 are detected by the magnetic sensor 90B when a phase at which the load torque HB becomes zero when the load torque HB with respect to the intake cam 23 is switched from the phase retarding direction to the phase advancing direction, i.e., the phase variation amount HC becomes the maximum to the phase retarding side.

The trailing ends 95 of the detection portions 91, 92 and 93 are detected by the magnetic sensor 90B when a phase at which the load torque HB becomes zero when the load torque HB with respect to the intake cam 23 is switched from the phase advancing direction to the phase retarding direction, i.e., the phase variation amount HC becomes the maximum to the phase advancing side.

A relationship between the cam angle signal DB and the fixed state of the variable valve timing mechanism 30 will be described with reference to FIG. 5.

Figures 5A, 5B, 5C:
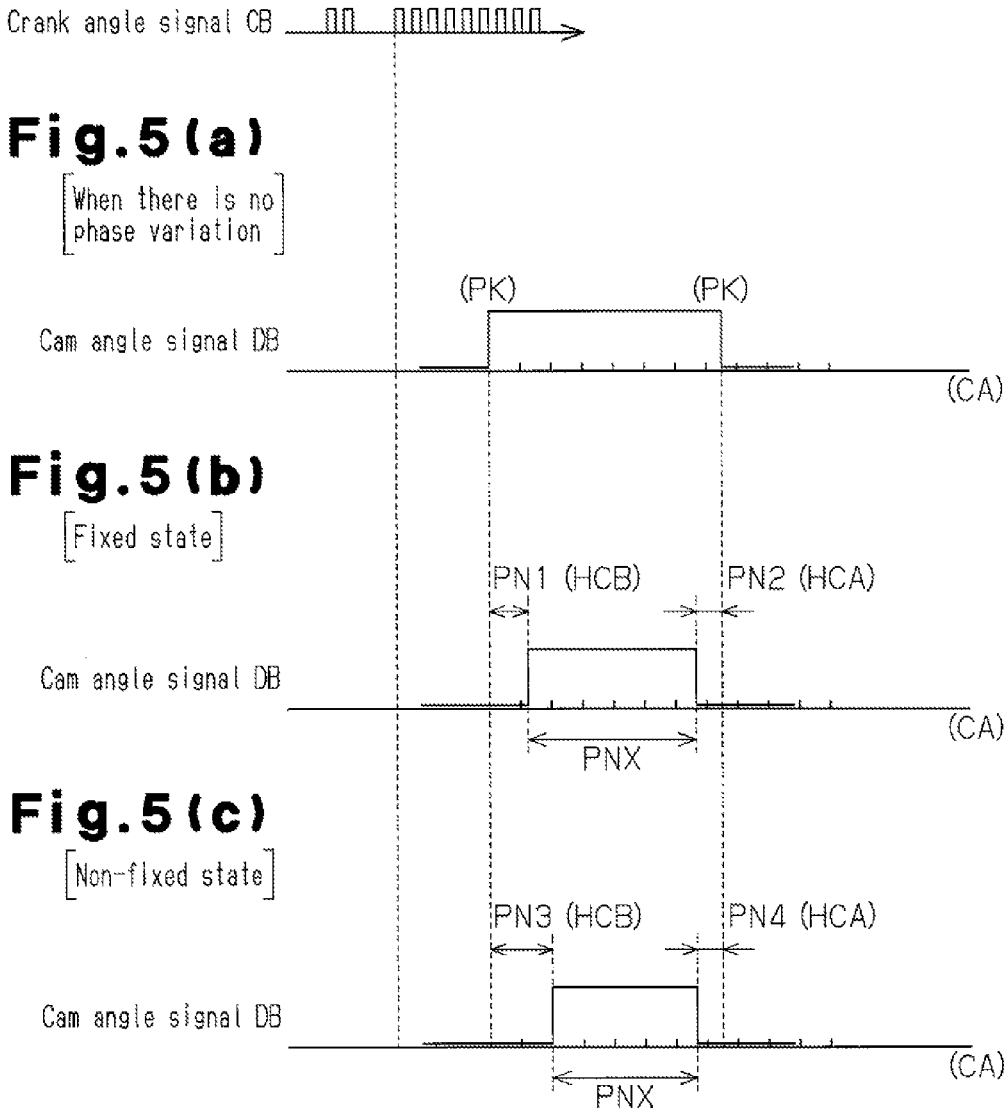
FIG. 5 is a schematic diagram showing a relationship between a cam angle signal and a fixed state of the variable valve timing mechanism in the variable valve actuation device of the embodiment.

A toothless portion of the crank angle signal CB in FIG. 5 indicates reference timing in one cycle of the crank angle signal CB. The cam angle signal DB represents a signal corresponding to the first detection portion 91. The cam angle signals DB of the second detection portion 92 and the third detection portion 93 are the same as that of the first detection portion 91 concerning variation of the cam angle signal DB with respect to whether the variable valve timing mechanism 30 is in the fixed state. Therefore, description of the cam angle signals DB of the second detection portion 92 and the third detection portion 93 will be not be repeated.

FIG. 5(*a*) shows a waveform of the cam angle signal DB of the first detection portion 91 when the relative rotational phase of the intake camshaft 22 is not varied with respect to the crankshaft 17. In this case, the relative rotational phase of the leading end 94 of the first detection portion 91 with respect to the crankshaft 17, and the relative rotational phase of the trailing end 95 of the first detection portion 91 with respect to the crankshaft 17 become reference relative rotational phases PK.

FIG. 5(*b*) shows a waveform of the cam angle signal DB of the first detection portion 91 when the variable valve timing mechanism 30 is in the fixed state.

At this time, the relative rotational phase of the leading end 94 of the first detection portion 91 with respect to the crankshaft 17 is deviated to the phase retarding side from the reference relative rotational phase PK by a predetermined rotational phase PN1. The relative rotational phase of the trailing end 95 of the first detection portion 91 with respect to the crankshaft 17 is deviated to the phase advancing side from the reference relative rotational phase PK by a predetermined rotational phase PN2.

Since the vane rotor 35 and the housing rotor 31 are fixed to each other when the variable valve timing mechanism 30 is in the fixed state, deviation in rotational phase is not generated between the vane rotor 35 and the housing rotor 31. However, since a force is applied from the intake valve 21 to the intake cam 23, a deflection amount of a timing chain interposed between the crankshaft 17 and the housing rotor 31 is varied, and relative rotational phases of the leading end 94 and the trailing end 95 of the first detection portion 91 with respect to the crankshaft 17 are varied.

FIG. 5(*c*) shows a waveform of the cam angle signal DB of the first detection portion 91 when the variable valve timing mechanism 30 is in the non-fixed state.

In this case, the relative rotational phase of the leading end 94 of the first detection portion 91 with respect to the crankshaft 17 is deviated to the phase retarding side from the reference relative rotational phase PK by a predetermined rotational phase PN3. This deviation amount, i.e., the predetermined rotational phase PN3 is greater than the predetermined rotational phase PN1, which is the deviation amount when the variable valve timing mechanism 30 is in the fixed state.

The relative rotational phase of the trailing end 95 of the first detection portion 91 with respect to the crankshaft 17 is deviated to the phase advancing side from the reference relative rotational phase PK by a predetermined rotational phase PN4. This deviation amount, i.e., the predetermined rotational phase PN4 is greater than the predetermined rotational phase PN2, which is the deviation amount when the variable valve timing mechanism 30 is in the fixed state.

Since the vane rotor 35 and the housing rotor 31 are not fixed to each other when the variable valve timing mechanism 30 is in the non-fixed state, a rotational phase is deviated between the vane rotor 35 and the housing rotor 31. When a force is applied from the intake valve 21 to the intake cam 23, the deflection amount of the timing chain interposed between the crankshaft 17 and the housing rotor 31 is varied. Hence, the relative rotational phases of the leading end 94 and the trailing end 95 of the first detection portion 91 with respect to the crankshaft 17 are largely varied as compared to when the variable valve timing mechanism 30 is in the fixed state.

As described above, the waveform of the cam angle signal DB of the first detection portion 91 is varied depending upon whether the variable valve timing mechanism 30 is in the fixed state or the non-fixed state. A deviation amount of the leading end 94 of the first detection portion 91 with respect to the crankshaft 17 from the reference relative rotational phase PK concerning the relative rotational phase becomes greater toward the phase retarding side when the variable valve timing mechanism 30 is in the non-fixed state as compared to when it is in the fixed state. A deviation amount of the trailing end 95 of the first detection portion 91 with respect to the crankshaft 17 from the reference relative rotational phase PK concerning the relative rotational phase becomes greater toward the phase advancing side when the variable valve timing mechanism 30 is in the non-fixed state as compared to when it is in the fixed state.

Figure 6:
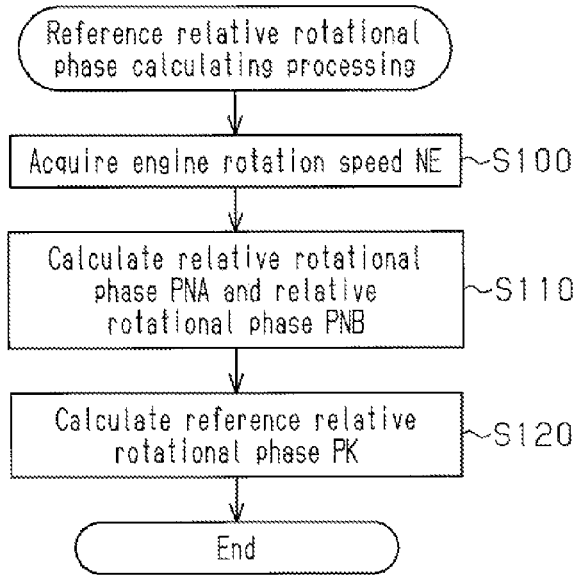
FIG. 6 is a flowchart showing a procedure of a reference relative rotational phase calculating processing, which is executed by an electronic control unit in the variable valve actuation device of the embodiment.

A specific procedure concerning the "reference relative rotational phase calculating processing", which is executed in the electronic control unit 61, will be described with reference to FIG. 6. This processing is repeatedly executed by the electronic control unit 61 at predetermined calculating intervals. In the reference relative rotational phase calculating processing, a reference relative rotational phase PK which is an average relative rotational phase of the intake camshaft 22 with respect to the crankshaft 17 is obtained.

In step S100, an engine rotation speed NE of the internal combustion engine 1 is acquired. Next, in step S110, a relative rotational phase PNA of the leading end 94 of the first detection portion 91 with respect to the crankshaft 17 is obtained based on the engine rotation speed NE and a rising signal of the leading end 94. A relative rotational phase PNB of the trailing end 95 with respect to the crankshaft 17 is obtained based on the engine rotation speed NE and a falling signal of the trailing end 95. Next, in step S120, an average of the relative rotational phase PNA and the relative rotational phase PNB is obtained, and this average is defined as the reference relative rotational phase PK.

Figure 7:
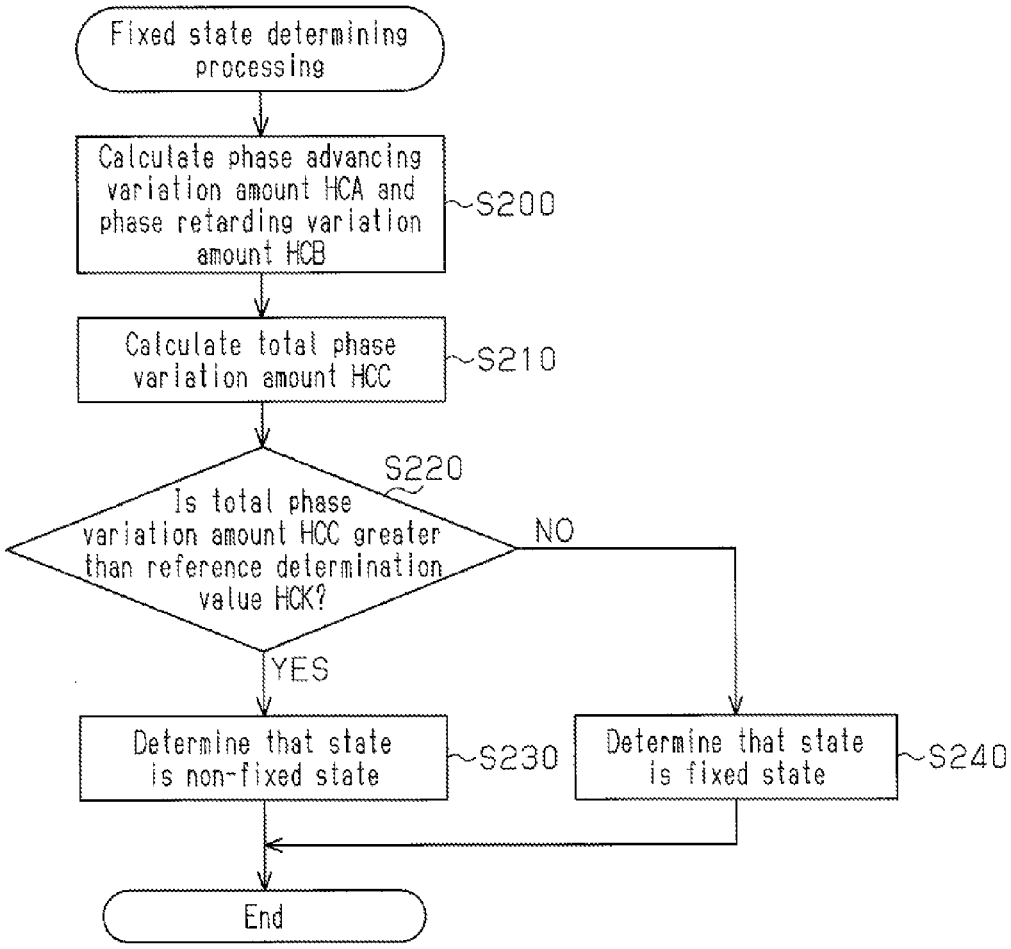
FIG. 7 is a flowchart showing a procedure of a fixed state determining processing, which is executed by the electronic control unit in the variable valve actuation device of the embodiment.

A specific procedure concerning the "fixed state determining processing", which is executed when the engine is stopped, will be described with reference to FIG. 7. This processing is repeatedly executed by the electronic control unit 61 at predetermined calculating intervals.

When an ignition switch is switched from ON to OFF, a phase advancing variation amount HCA is obtained in step S200 from the difference between the relative rotational phase PNA and the reference relative rotational phase PK of the leading end 94. A phase retarding variation amount HCB is obtained from the difference between the relative rotational phase PNB and the reference relative rotational phase PK of the trailing end 95. Next, in step S120, the sum of the phase advancing variation amount HCA and the phase retarding variation amount. HCB is calculated as a total phase variation amount HCC.

In step S220, the total phase variation amount HCC and a reference determination value HCK are compared with each other. When the total phase variation amount HCC is greater than the reference determination value HCK, it is determined in step S230 that the intake camshaft 22 is not fixed to the crankshaft 17. When the total phase variation amount HCC is equal to or smaller than the reference determination value HCK, it is determined in step S240 that the intake camshaft 22 is fixed to the crankshaft 17.

When the engine is stopped, it is determined whether the intake camshaft 22 is fixed to the crankshaft 17 in this manner. The determination results are memorized, and the same determination results are used for various kinds of control operations when the engine is started.

In the meantime, friction of the variable valve timing mechanism 30 differs depending upon individual variable valve timing mechanism 30, a total phase variation amount HCC when the mechanism 30 is in the fixed state also differs. A total phase variation amount HCC when the variable valve timing mechanism 30 is in the fixed state differs also due to variation with time of the friction of the mechanism 30. If the reference determination value HCK is fixed, there is fear that it is not possible to precisely determine whether the intake camshaft 22 is fixed to the crankshaft 17. Hence, the reference determination value HCK is learned during operation of the engine.

Figure 8:
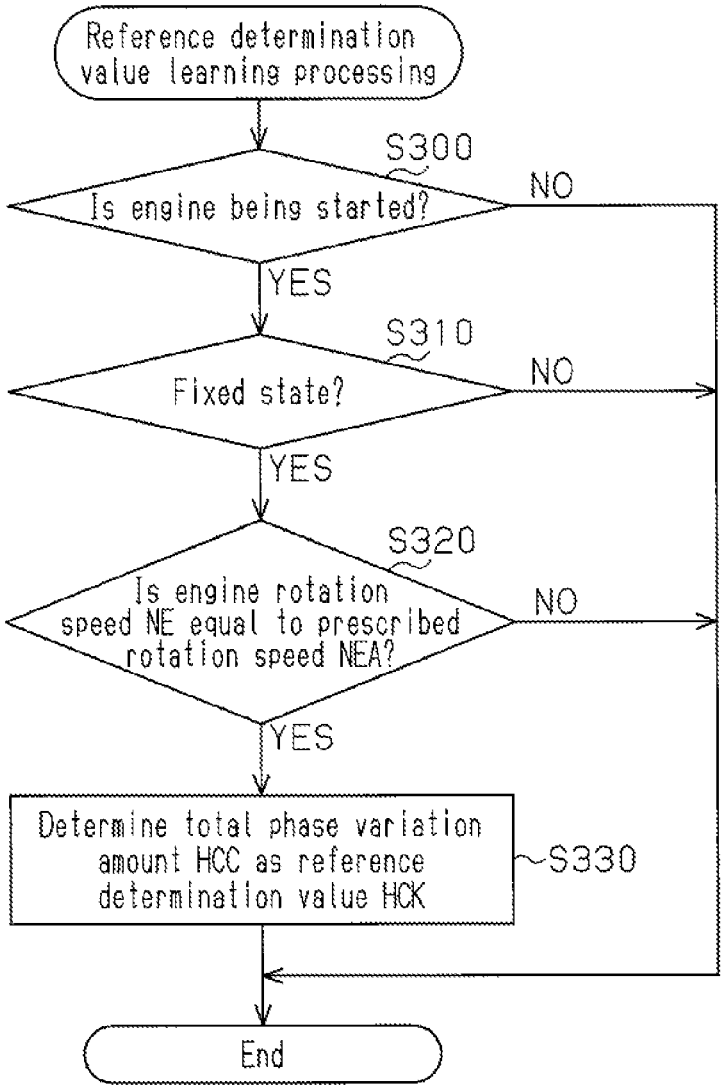
FIG. 8 is a flowchart showing a procedure of a reference determination value learning processing, which is executed by the electronic control unit in the variable valve actuation device of the embodiment.

A specific procedure concerning the "learning processing of reference determination value HCK" will be described with reference to FIG. 8. This processing is repeatedly executed by the electronic control unit 61 at predetermined calculating intervals.

In steps S300 and S310, it is determined whether the internal combustion engine 1 is being started and whether the variable valve timing mechanism 30 is in the fixed state. If the determination result is YES, it is determined in step S320 whether the engine rotation speed NE of the internal combustion engine 1 is equal to a prescribed rotation speed NEA. If the determination result is YES, the total phase variation amount HCC is obtained in step S330, and this total phase variation amount HCC is set as the reference determination value HCK.

When the engine rotation speed NE becomes equal to a critical rotation speed NEG, which is smaller than the prescribed rotation speed NEA, the cam angle signal DB becomes unstable. Thus, signals corresponding to the leading end 94 and the trailing end 95 of each detection portion cannot precisely be detected. Hence, the prescribed rotation speed NEA when the reference determination value HCK is learned is set greater than the critical rotation speed NEG, with which the cam angle signal DB can precisely be detected.

One example of transition of various kinds of parameters when the "fixed state determining processing" is executed during stoppage of the engine will be described with reference to FIG. 9. This processing is repeatedly executed by the electronic control unit 61 at predetermined calculating intervals.

At point in time t1, i.e., when the engine is stopped by switching the ignition switch from ON to OFF, a target, phase of the variable valve timing mechanism 30 is set to the intermediate VTmdl. If the valve timing VT is set closer to the phase advancing side than the intermediate VTmdl when the engine is stopped, the oil control valve 53 changes the valve timing VT to the phase retarding side.

At point, in time t2, the limiting pin 41 is fitted into the engaging hole 48 and the vane rotor 35 is fixed to the housing rotor 31. At this time, since rotation of the intake camshaft 22 relative to the crankshaft 17 is suppressed, the phase variation amount HC becomes small.

At point in time t3, i.e., when the engine rotation speed NE of the internal combustion engine 1 becomes equal to the prescribed rotation speed NEA, it is determined whether the intake camshaft 22 is fixed to the crankshaft 17 based on the total phase variation amount HCC of the intake camshaft 22 with respect to the crankshaft 17. In this example, since the total phase variation amount HCC is smaller than the reference determination value HCK, it is determined that the intake camshaft 22 is fixed to the crankshaft 17.

If the vane rotor 35 is not fixed to the housing rotor 31 when the engine rotation speed NE becomes equal to the prescribed rotation speed NEA, the total phase variation amount HCC becomes greater than the reference determination value HCK. In this case, it is determined that the intake camshaft 22 is not fixed to the crankshaft 17.

Figure 10:
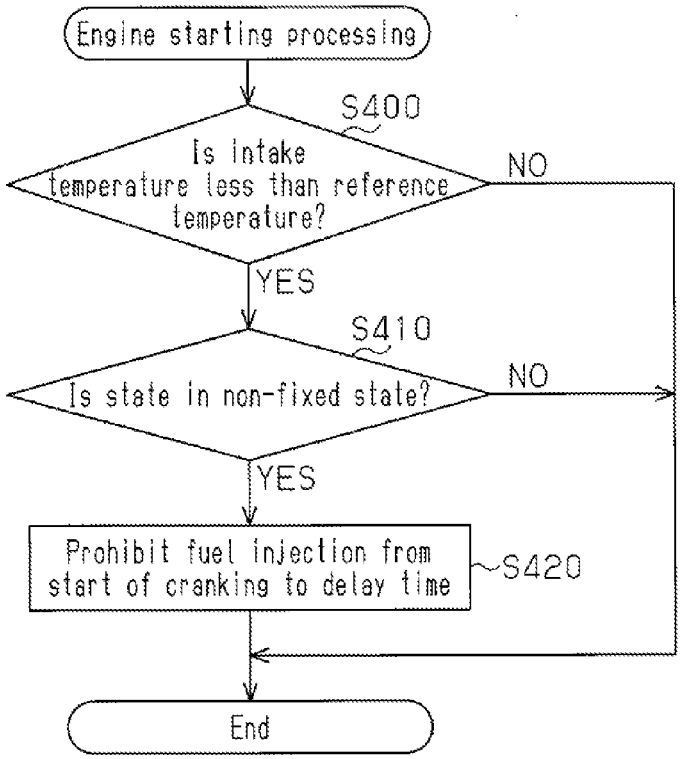
FIG. 10 is a flowchart showing a procedure of a engine starting processing, which is executed by the electronic control unit in the internal combustion engine of the embodiment.

A specific procedure concerning the "engine starting processing", which is executed when the engine is to be started, will be described with reference to FIG. 10. In the engine starting processing, fuel injection control is executed using the determination result concerning whether the intake camshaft 22 is fixed to the crankshaft 17. This processing is repeatedly executed by the electronic control unit 61 at predetermined calculating intervals.

When the ignition switch is switched from OFF to ON, it is determined in steps S400 and S410 whether an intake temperature is lower than a reference temperature and whether the variable valve timing mechanism 30 is in the non-fixed state. If a determination result is YES, fuel injection is prohibited in step S420 until time elapsed after the start of cranking exceeds delay time. The delay time is set as a period for securing time during which the limiting pin 41 is fitted into the engaging hole 48 at the time of cranking.

If the determination result in any one of steps S400 and S410 is NO, the fuel injection control is executed in a normal mode. That is, fuel is injected from starting timing of cranking.

A reference temperature in step S400 is set as a temperature at which, starting performance of the internal combustion engine 1 cannot be ensured when the variable valve timing mechanism 30 is in the non-fixed state.

That is, in the engine starting processing, when the starting performance of the internal combustion engine 1 is deteriorated, a period from the start of cranking to a lapse of predetermined time is defined as a period during which the variable valve timing mechanism 30 is brought into the fixed without fuel injection.

According to the embodiment, the following advantages are achieved.

(1) In the embodiment, it is determined whether the crankshaft 17 and the intake camshaft 22 are fixed to each other based on the total phase variation amount HCC, which is the variation amount of the relative rotational phase of the intake camshaft 22 with respect to the crankshaft 17.

When the intake camshaft 22 receives a force from the intake valve 21, the relative rotational phase is varied. If the phase variation amount HC of the relative rotational phase when the state is the non-fixed state and the phase variation amount HC of the relative rotational phase when the state is the fixed state are compared with each other, the former amount becomes greater than the latter amount. That is, the variation amount of the relative rotational phase is varied depending upon whether the crankshaft 17 and the intake camshaft 22 are in the fixed state or the non-fixed state. According to the above configuration, since it is determined whether the crankshaft 17 and the intake camshaft 22 are fixed to each other based on the total phase variation amount HCC, it is possible to make the determination precisely.

(2) In the embodiment, the cam position sensor 90 is provided for detecting the timing rotor 90A, which includes the leading end 94, which forms a rising signal, and the trailing end 95, which corresponds to a falling signal. The leading end 94 is provided in the vicinity of the location where the variation amount of the rotation torque becomes zero in the torque reducing process of the intake camshaft 22. The trailing end 95 is provided in the vicinity of the location where the variation amount of the rotation torque becomes zero in torque increasing process of the intake camshaft 22.

When a direction of a force applied from the intake valve 21 to the intake camshaft 22 is opposite from the rotating direction of the intake camshaft 22, the rotation torque of the intake camshaft 22 is reduced. When the variation amount of the rotation torque becomes zero in the torque reducing process of the intake camshaft 22, the phase variation amount HC of the intake camshaft 22 in the phase retarding direction becomes the maximum. When the direction of the force is the leading direction with respect to the rotating direction of the rotating body, the rotation torque of the intake camshaft 22 is increased. When the variation amount of the rotation torque becomes zero in the torque increasing process of the intake camshaft 22, the phase variation amount HC of the intake camshaft 22 in the phase advancing direction becomes the maximum. According to this configuration, since the cam position sensor 90 detects the rising signal when the rotation torque becomes zero in the rotation torque reducing process of the intake camshaft 22, it is possible to detect the phase retarding variation amount HCB when the intake camshaft 22 is varied to a maximum level in the phase retarding direction. Further, since the failing signal is detected when the torque becomes zero in the rotation torque increasing process of the intake camshaft 22, it is possible to detect the phase advancing variation amount HCA when the intake camshaft 22 is varied to a maximum level in the phase advancing direction.

(3) In the embodiment, the electronic control unit 61 calculates the phase variation amount HC based on a rising signal detected by the cam position sensor 90. The cam position sensor 90 detects, as a rising signal, timing when the load torque HB applied to the intake camshaft 22 is switched from the phase retarding direction to the phase advancing direction.

When the direction of the force applied from the intake valve 21 to the intake camshaft 22 is changed from the direction opposite from the rotating direction of the rotating body to the leading direction, the relative rotational phase of the intake camshaft 22 with respect to the crankshaft 17 is largely varied to the phase retarding side. According to this configuration, since the cam position sensor 90 detects the timing when the torque applied to the intake camshaft 22 is switched from the phase retarding direction (direction opposite from the rotating body) to the phase advancing direction (leading direction of the rotating body), it is possible to calculate the phase variation amount HC to the phase retarding side of the relative rotational phase of the intake camshaft 22 with respect to the crankshaft 17.

(4) In this embodiment, the electronic control unit 61 calculates the phase variation amount HC based on the falling signal detected by the cam position sensor 90. The sensor 90 detects, as a falling signal, timing when the load torque HB applied to the intake camshaft 22 is switched from the phase advancing direction to the phase retarding direction.

When the direction of the force applied from the intake valve 21 to the intake camshaft 22 is changed from the leading direction with respect to the rotating direction of the rotating body to the opposite direction, the relative phase of the intake camshaft 22 with respect to the crankshaft 17 is largely varied to the phase advancing side. According to this configuration, since the cam position sensor 90 detects timing when the load torque HB applied to the intake camshaft 22 is switched from the phase advancing direction (leading direction of the rotating body) to the phase retarding direction (direction opposite to that of the rotating body), it is possible to calculate the phase variation amount HC to the phase advancing side of the relative rotational phase of the intake camshaft 22 with respect to the crankshaft 17.

(5) In this embodiment, the cam position sensor 90 detects the first timing when the load torque with respect to the intake camshaft 22 is switched from the phase retarding direction to the phase advancing direction, and the second timing when the load torque with respect to the intake camshaft 22 is switch from the phase advancing direction to the phase retarding direction, and the phase variation amount HC is calculated based on the first timing and the second timing.

According to this configuration, since the total phase variation amount HCC is calculated based on the first timing, which is related to the variation amount of the relative rotational phase on the phase retarding side, and the second timing, which is related to the variation amount of the relative rotational phase on the phase advancing side, it is possible to more precisely obtain the total phase variation amount HCC.

(6) In this embodiment, when the internal combustion engine 1 is in the stoppage process, the electronic control unit 61 determines whether the crankshaft 17 and the intake camshaft 22 are fixed to each other.

According to this configuration, it is determined whether the crankshaft 17 and the intake camshaft 22 are in the fixed state or the non-fixed state in the stoppage process of rotation of the internal combustion engine 1. Hence, when the engine is started next time, it is possible to control the starting state suitable for the fixed state or the non-fixed state.

(7) In this embodiment, when the engine rotation speed NE in the stoppage process of the internal combustion engine 1 is reduced to the prescribed rotation speed NEA, the electronic control unit 61 determines whether the crankshaft 17 and the intake camshaft 22 are fixed to each other.

It is preferable to make the determination whether the crankshaft 17 and the intake camshaft 22 are fixed to each other at late timing in the stoppage process of the internal combustion engine 1. If this determination is made at an initial stage of the stoppage process of the internal combustion engine 1, there is a possibility that due to rotations of the crankshaft 17 and the intake camshaft 22, the rotating bodies are fixed to each other. In this case, this determination and the actual fixed state between the crankshaft 17 and the intake camshaft 22 become different from each other. In this aspect, according to the above described configuration, since the determination is made after the engine rotation speed NE is reduced to the prescribed rotation speed NEA, it is possible to lower the frequency that, the determination result and the actual fixed state between the crankshaft 17 and the intake camshaft 22 are different from each other.

(8) In this embodiment, the reference determination value HCK is renewed based on the crank angle signal CB and the cam angle signal DB when the intake camshaft 22 and the crankshaft 17 are fixed to each other.

The variable valve timing mechanism 30 has individual differences. That is, the degree of the phase variation amount HC of the intake camshaft 22 with respect to the crankshaft 17 differs due to size variations of the intake camshaft 22 and the crankshaft 17 and assembling variation therebetween. In this aspect, according to this configuration, the reference determination value HCK used for determining whether the intake camshaft 22 is fixed to the crankshaft 17 is renewed by the total phase variation amount HCC based on the crank angle signal CB and the cam angle signal DB when the intake camshaft 22 and the crankshaft 17 are fixed to each other. According to this configuration, it is possible to more precisely make the determination.

(9) In this embodiment, after the internal combustion engine 1 is started and when the intake camshaft 22 and the crankshaft 17 are fixed to each other, the reference determination value HCK is renewed based on the crank angle signal CB and the cam angle signal DB.

According to this configuration, the reference determination value HCK is renewed when the engine is started before the stoppage processing of the internal combustion engine 1 is executed. Therefore, when the engine is stopped thereafter, it is possible to determine whether the crankshaft 17 and the intake camshaft 22 are fixed to each other using the reference determination value HCK.

(10) In the embodiment, when the relative rotational phase is not fixed at the time of start of the internal combustion engine 1, the starting timing of fuel injection is delayed as compared with a case where the relative rotational phase is fixed to the intermediate phase PM.

When the engine is started and the state is the non-fixed state, injected fuel is not easily burned. According to this configuration, the starting timing of fuel injection when the engine is started and the state is non-fixed state is delayed as compared with a case where the engine is started and the state is the fixed state. Therefore, it is possible to reduce the amount of injected fuel that adheres to the spark plug.

Other Embodiments

Aspects of the present invention are not limited to the embodiment described above, and the aspects can be changed in the following manner and carried out. The following modifications are not applied only to the above-described embodiment, and different modifications may be combined with each other and carried out.

Although the phase fixing mechanism 40 includes the upper groove 47 in the above-described embodiment, the upper groove 47 may be omitted. In this case, the engaging hole 48 and the limiting pin 41 provided corresponding to the intermediate phase PM constitute the phase fixing mechanism 40.

Although the upper groove 47 of the phase fixing mechanism 40 is formed from the intermediate phase PM toward the phase retarding side in the above-described embodiment, the upper groove 47 may also be formed from the intermediate phase PK toward the phase advancing side.

Although the reference determination value HCK is learned when the engine is started in the above-described embodiment, this may previously be set. In the internal combustion engine 1, which executes automatic stoppage for stopping the engine at the time of idling during operation of the engine from the start of the engine to the stop of the engine, it is possible to learn the reference determination value HCK at the time of the predetermined engine rotation speed NE when the engine is automatically stopped.

In this case, the phase variation amount of the intake camshaft 22 with respect to the crankshaft 17 is varied depending upon the state of the engine. If a case where the internal combustion engine 1 is started and a case where the internal combustion engine 1 is automatically stopped are compared with each other, the case where the internal combustion engine 1 is automatically stopped is close to a state where the operation is stopped. In this modification, since the reference determination value HCK is obtained at the time of automatic stoppage, it is possible to more precisely determine whether or not the intake camshaft 22 is fixed to the crankshaft 17 as compared with a case where the reference determination value HCK obtained when the engine is started is used.

Although the timing rotor 90A is provided with the detection portions 91, 92 and 93 corresponding to the intake cams 23 in the above-described embodiment, any one or two of them may be omitted. Alternatively, any two of them may be integrally formed together.

Although the timing rotor 90A is provided only with the detection portions 91, 92 and 93 for detecting the relative rotational phase between the crankshaft 17 and the intake camshaft 22 in the above-described embodiment, it is possible to provide a detection portion for discriminating between the cylinders.

In the above-described embodiment, the trailing end 95 and the leading end 94 of the detection portions 91, 92 and 93 are provided to correspond to a phase at which the load torque HB becomes zero, i.e., a phase at which the total phase variation amount HCC becomes the maximum to the phase retarding side or the phase advancing side. Alternatively, the trailing end 95 and the leading end 94 of the detection portions 91, 92 and 93 may be provided in the following manner.

(a) Any one or two of the detection portions 91, 92 and 93 may be provided to correspond to a phase at which load torques HB of the trailing end 95 and the leading end 94 become the maximum, i.e., a phase at which the total phase variation amount HCC becomes close to zero. According to this configuration, it is possible to obtain the relative rotational phase between the crankshaft 17 and the intake camshaft 22 by a detection portion provided to correspond to the phase at which the total phase variation amount HCC becomes close to zero.

(b) The trailing end 95 of each of the detection portions 91, 92 and 93 may be provided at a position separated away from the phase instead of the position where the phase variation amount HC becomes the maximum to the phase retarding side.

(c) The leading end 94 of each of the detection portions 91, 92 and 93 may be provided at a position separated away from the phase instead of the position where the phase variation amount HC becomes the maximum to the phase advancing side.

In the above-described embodiment, it is determined whether the intake camshaft 22 is fixed to the crankshaft 17 based on the total phase variation amount HCC of the intake camshaft 22 with respect to the crankshaft 17. Instead of this determination manner, it is possible to make the determination based on the cam angle signal DB only.

Figure 11:
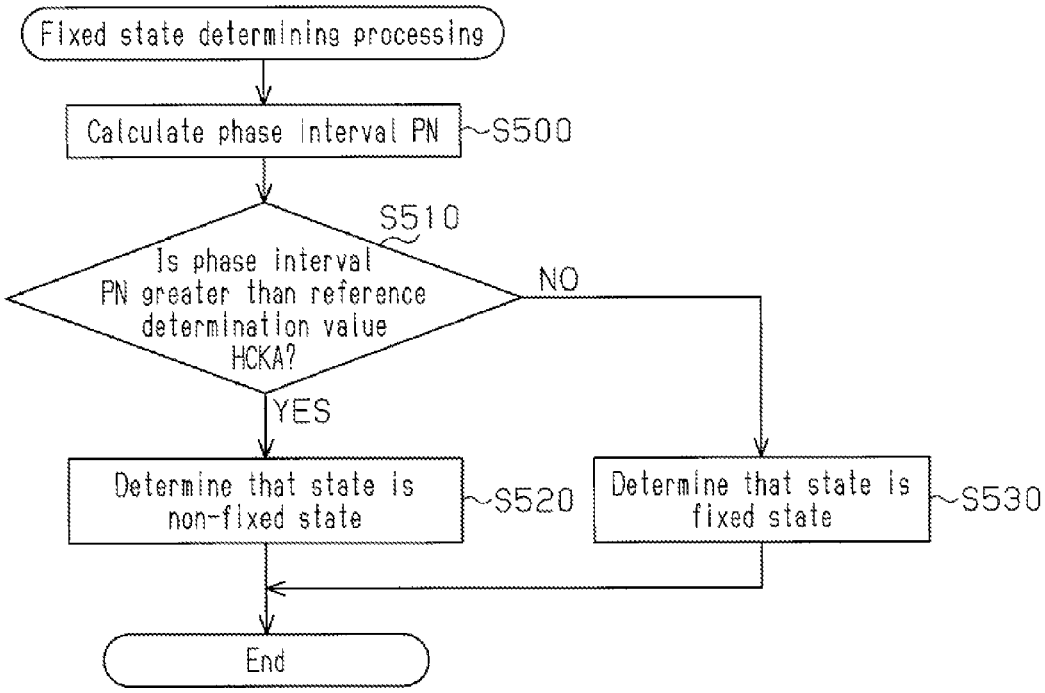
FIG. 11 is a flowchart showing a fixed state determining processing, which is executed by an electronic control unit in a variable valve actuation device of a second embodiment of the invention.

A procedure of the "fixed state determining processing" based on the cam angle signal DB will be described with reference to FIGS. 5 and 11.

When the ignition switch is switched from ON to OFF, a phase interval PNX (period variation amount) is obtained in step S500 based on the engine rotation speed NE, detecting timing of the leading end 94 and detecting timing of the trailing end 95 of the first detection portion 91. Next, in step S510, the phase interval PNX and the reference determination value HCKA are compared with each other. The reference determination value HCKA is set as a phase interval PNX in the predetermined rotation speed when the engine is started.

When the phase interval PNX is greater than the reference determination value HCKA, it is determined in step S520 that the intake camshaft 22 is not fixed to the crankshaft 17. When the phase interval PNX is equal to or smaller than the reference determination value HCKA, it is determined in step S530 that the intake camshaft 22 is fixed to the crankshaft 17. According to this configuration, since it is determined whether the crankshaft 17 and the intake camshaft 22 are fixed to each other based on the phase interval PNX, it is possible to precisely make the determination.

Although it is determined whether the intake camshaft 22 is fixed to the crankshaft 17 when the engine is stopped in the above-described embodiment, the determination timing is not limited to this. For example, it is possible to make this determination when the engine is started. In an internal combustion engine 1 having a function for automatically stopping the engine, this determination may foe made when the engine is automatically stopped.

In the above-described embodiment and the above modification, the total phase variation amount HCC or the phase interval PNX is obtained in relation between the crankshaft 17 and the intake camshaft 22, and it is determined whether the intake camshaft 22 is fixed to the crankshaft 17 based on the total phase variation amount HCC or the phase interval PNX. However, the subject to which the present invention is applied is not limited to the crankshaft 17 and the intake camshaft 22. For example, the invention may also be applied to a case where a fixed state of the relative rotational phase between the housing rotor 31 and the intake camshaft 22 is determined. The invention can also be applied to a case where a fixed state of the relative rotational phase between the crankshaft 17 and the housing rotor 31 is determined.

Although the invention is applied to the variable valve actuation device 20, which includes the variable valve timing mechanism 30 fixed at the intermediate VTmdl in the above-described embodiment, the subject to which the invention is applied is not limited to the variable valve timing mechanism 30. For example, the invention may be applied to a variable valve actuation device 20 including a variable valve timing mechanism 30 is fixed at the most retarded angle VTmin.

In the above-described embodiment, the invention is applied to the variable valve timing mechanism 30 including the phase fixing mechanism 40, which fixes the housing rotor 31 and the vane rotor 35 to each other through one limiting pin 41. However, the invention can also be applied to a variable valve timing mechanism 30 including a phase fixing mechanism 40 that fixes the housing rotor 31 and the vane rotor 35 to each other through two limiting pins 41.

Although the vane rotor 35 is provided with the limiting pin 41 and the housing rotor 31 is provided with the engaging hole 48 in the above-described embodiment, the housing rotor 31 may be provided with the limiting pin 41 and the vane rotor 35 may be provided with the engaging hole 48.

Although the engaging direction and the disengaging direction between the limiting pin 41 and the engaging hole 48 are equal to the axial direction of the vane rotor 35 in the above-described embodiment, it is also possible to form the limiting pin 41 and the engaging hole 48 such that the engaging direction and the disengaging direction match with a radial direction of the vane rotor 35.

Although the invention is applied to the variable valve timing mechanism 30 which fixes the valve timing VT at the most retarded VTmin in the above-described embodiment, the invention can also be applied to a variable valve timing mechanism 30 that fixes the valve timing VT at the most advanced angle VTmax.

DESCRIPTION OF THE REFERENCE NUMERALS

1 . . . internal combustion engine, 10 . . . engine body, 11 . . . cylinder block, 12 . . . cylinder head, 13 . . . cylinder, 14 . . . piston, 15 . . . combustion chamber, 16 . . . fuel injection valve, 17 . . . crankshaft, 18 . . . oil pan, 20 . . . variable valve actuation device, 21 . . . intake valve, 21A . . . rocker arm, 22 . . . intake camshaft, 23 . . . intake cam, 23A . . . first intake cam, 23B . . . second intake cam, 23C . . . third intake cam, 24 . . . nose, 25 . . . vertex, 26 . . . leading skirt, 27 . . . trailing skirt, 28 . . . exhaust valve, 29 . . . exhaust camshaft, 30 . . . variable valve timing mechanism, 31 . . . housing rotor, 31A . . . partition wall, 32 . . . housing body, 33 . . . sprocket, 34 . . . cover, 35 . . . vane rotor, 36 . . . vane, 37 . . . vane accommodating chamber, 38 . . . phase advancing chamber, 39 . . . phase retarding chamber, 40 . . . phase fixing mechanism, 41 . . . limiting pin, 42 . . . limiting spring, 43 . . . accommodating chamber, 44 . . . limiting chamber, 45 . . . spring chamber, 46 . . . engaging portion, 47 . . . upper groove, 48 . . . engaging hole, 50 . . . lubricating device, 51 . . . lubricating oil passage, 52 . . . oil pump, 53 . . . oil control valve, 60 . . . control unit, 61 . . . electronic control unit, 80 . . . crank position sensor (input angle sensor), 90 . . . cam position sensor (output angle sensor), 90A . . . timing rotor, 90B . . . magnetic sensor, 91 . . . first, detection portion, 92 . . . second detection portion, 93 . . . third detection portion, 94 . . . leading end (first phase detection portion), 95 . . . trailing end (second phase detection portion)

The invention claimed is:

1. A variable valve actuation device for an internal combustion engine, the device comprising an output rotating body, which drives an engine valve, and an input rotating body, which drives the output rotating body, the variable valve actuation device having a function for changing a relative rotational phase, which is a rotational phase of the output rotating body with respect to that of the input rotating body, and a function for fixing the input rotating body and the output rotating body to each other when the relative rotational phase is a specific phase, the variable valve actuation device further comprising an input angle sensor, which detects a rotational phase of the input rotating body and outputs an input angle signal, and an output angle sensor, which detects the rotational phase of the output rotating body and outputs an output angle signal as a rising signal and a falling signal, wherein the output angle sensor is provided for detecting a timing rotor, which includes a first phase detection portion forming the rising signal and a second phase detection portion corresponding to the falling signal, the first phase detection portion is provided near a location where a variation amount of a torque of the output rotating body becomes zero in a torque reducing process of the output rotating body, the second phase detection portion is provided near a location where the variation amount of the torque of the output rotating body becomes zero in a torque increasing process of the output rotating body, and a phase variation amount, which is a variation amount of the relative rotational phase, is calculated based on the input angle signal and on the rising signal and the falling signal of the output angle sensor, and it is determined whether the input rotating body and the output rotating body are fixed to each other based on the phase variation amount.

2. The variable valve actuation device for an internal combustion engine according to claim 1, wherein, when the internal combustion engine is in the stoppage process, it is determined whether the input rotating body and the output rotating body are fixed to each other.

3. The variable valve actuation device for an internal combustion engine according to claim 2, wherein, when an engine rotation speed is reduced to a prescribed rotation speed in the stoppage process of the internal combustion engine, it is determined whether the input rotating body and the output rotating body are fixed to each other.

4. The variable valve actuation device for an internal combustion engine according to claim 1, wherein, when the phase variation amount is smaller than a reference determination value, it is determined that the input rotating body and the output rotating body are fixed to each other, and when the phase variation amount is greater than the reference determination value, it is determined that the input rotating body and the output rotating body are not fixed to each other.

5. The variable valve actuation device for an internal combustion engine according to claim 4, wherein the reference determination value is renewed based on the input angle signal and the output angle signal when the output rotating body and the input rotating body are fixed to each other.

6. The variable valve actuation device for an internal combustion engine according to claim 5, wherein, after the internal combustion engine is started and when the output rotating body and the input rotating body are fixed to each other, the reference determination value is renewed based on the input angle signal and the output angle signal.

7. The variable valve actuation device for an internal combustion engine according to claim 6, the device further comprising a function for fixing the input rotating body and the output rotating body to each other when the internal combustion engine is automatically stopped, wherein, when the internal combustion engine is automatically stopped and the input rotating body and the output rotating body are fixed to each other, the reference determination value is renewed based on the input angle signal and the output angle signal.

8. The variable valve actuation device for an internal combustion engine according to claim 1, wherein, if the relative rotational phase is not fixed when the internal combustion engine is started, starting timing of fuel injection is delayed as compared with a case where the relative rotational phase is fixed.

9. A variable valve actuation device for an internal combustion engine, the device comprising an output rotating body, which drives an engine valve, and an input rotating body, which drives the output rotating body, the variable valve actuation device having a function for changing a relative rotational phase, which is a rotational phase of the output rotating body with respect to that of the input rotating body, and a function for fixing the input rotating body and the output rotating body to each other when the relative rotational phase is a specific phase, the variable valve actuation device further comprising an input angle sensor, which detects a rotational phase of the input rotating body, and an output angle sensor, which detects a rotational phase of the output rotating body, wherein the output angle sensor outputs, as the rising signal, which is an output angle signal, timing when a torque applied to the output rotating body is switched from a phase retarding direction to a phase advancing direction, the phase variation amount is calculated based on an input angle signal, which is a detection signal of the input angle sensor, and the rising signal of the output angle sensor, and it is determined whether the input rotating body and the output rotating body are fixed to each other based on the phase variation amount, which is a variation amount of the relative rotational phase.

10. A variable valve actuation device for an internal combustion engine, the device comprising an output rotating body, which drives an engine valve, and an input rotating body, which drives the output rotating body, the variable valve actuation device having a function for changing a relative rotational phase, which is a rotational phase of the output rotating body with respect to that of the input rotating body, and a function for fixing the input rotating body and the output rotating body to each other when the relative rotational phase is a specific phase, the variable valve actuation device further comprising an input angle sensor, which detects a rotational phase of the input rotating body, and an output angle sensor, which detects a rotational phase of the output rotating body, wherein the output angle sensor outputs, as the rising signal, which is an output angle signal, timing when a torque applied to the output rotating body is switched from a phase advancing direction to a phase retarding direction, the phase variation amount is calculated based on an input angle signal, which is a detection signal of the input angle sensor, and the falling signal of the output angle sensor, and it is determined whether the input rotating body and the output rotating body are fixed to each other based on the phase variation amount, which is a variation amount of the relative rotational phase.

11. A variable valve actuation device for an internal combustion engine, the device comprising an output rotating body, which drives an engine valve, and an input rotating body, which drives the output rotating body, the variable valve actuation device having a function for changing a relative rotational phase, which is a rotational phase of the output rotating body with respect to that of the input rotating body, and a function for fixing the input rotating body and the output rotating body to each other when the relative rotational phase is a specific phase, the variable valve actuation device further comprising an input angle sensor, which detects a rotational phase of the input rotating body, and an output angle sensor, which detects a rotational phase of the output rotating body, wherein the output angle sensor detects first timing when a torque applied to the output rotating body is switched from a phase retarding direction to a phase advancing direction, and second timing when the torque applied to the output rotating body is switched from the phase advancing direction to the phase retarding direction, and outputs the first timing and the second timing as an output signal, the phase variation amount is calculated based on an input angle signal, which is a detection signal of the input angle sensor, and the first timing and the second timing output from the output angle sensor, and it is determined whether the input rotating body and the output rotating body are fixed to each other based on the phase variation amount, which is a variation amount of the relative rotational phase.

12. A variable valve actuation device for an internal combustion engine, the device comprising an output rotating body, which drives an engine valve, and an input rotating body, which drives the output rotating body, the variable valve actuation device having a function for changing a relative rotational phase, which is a rotational phase of the output rotating body with respect to that of the input rotating body, and a function for fixing the input rotating body and the output rotating body to each other when the relative rotational phase is a specific phase, the variable valve actuation device further comprising an input angle sensor, which detects a phase of the input rotating body, and an output angle sensor, which detects a rotational phase of the output rotating body, wherein the output angle sensor detects, as first detecting timing, timing when a torque applied to the output rotating body is switched from a phase advancing direction to a phase retarding direction, and detects, as second detecting timing, timing when the torque applied to the output rotating body is switched from the phase retarding direction to the phase advancing direction, when a period variation amount, which is a variation amount of an interval between the first detecting timing and the second detecting timing, is smaller than a reference determination value, it is determined that the output rotating body is fixed to the input rotating body, and when the period variation amount is greater than the reference determination value, it is determined that the output rotating body is not fixed to the input rotating body.

* * * * *